US007581380B2

(12) United States Patent
Wahl

(10) Patent No.: US 7,581,380 B2
(45) Date of Patent: Sep. 1, 2009

(54) AIR-BREATHING ELECTROSTATIC ION THRUSTER

(76) Inventor: Eric L. Wahl, 7775 N. State St., Fresno, CA (US) 93722

( * ) Notice: Subject to any disclaimer, the term of this patent is extended or adjusted under 35 U.S.C. 154(b) by 513 days.

(21) Appl. No.: 11/500,091

(22) Filed: Aug. 7, 2006

(65) Prior Publication Data

US 2008/0028743 A1 Feb. 7, 2008

(51) Int. Cl.
*F03H 1/00* (2006.01)
*H05H 1/00* (2006.01)

(52) U.S. Cl. ..... 60/202; 313/360.1; 313/362.1; 315/111.81; 315/111.91

(58) Field of Classification Search ..... 60/202, 60/203.1; 313/359.1, 360.1, 362.1; 315/111.81, 315/111.91
See application file for complete search history.

(56) References Cited

U.S. PATENT DOCUMENTS 3,156,090 A 11/1964 Kaufman
3,223,038 A 12/1965 Bahnson, Jr.
3,279,176 A * 10/1966 Boden ..... 60/202
3,374,941 A * 3/1968 Okress ..... 315/111.91
3,952,228 A 4/1976 Reader et al.
4,011,719 A 3/1977 Banks
4,838,021 A 6/1989 Beattie
5,924,277 A * 7/1999 Beattie et al. ..... 60/202
6,145,298 A 11/2000 Burton, Jr.
6,834,492 B2 12/2004 Hruby et al.

* cited by examiner

*Primary Examiner*—Ted Kim
(74) *Attorney, Agent, or Firm*—Richard A. Ryan

(57) ABSTRACT

An improved air-breathing electrostatic ion thruster specially configured for use in low-Earth atmosphere comprises a housing having an electrically conductive inner surface defining an ionization chamber. Ambient atmospheric gas passes through a forward screen electrode at the chamber inlet to be ionized by an inner electrode disposed in the chamber. The ions are directed rearward through the aligned apertures of a rearward screen electrode and an accelerator electrode at the chamber outlet to generate thrust. A source of electrical power, which can be solar cells, a battery and/or a generator, provides current of a first polarity to the inner surface, forward screen electrode and rearward screen electrode and current of a second polarity to the inner electrode and accelerator electrode. A controller controls the amount and/or polarity of the current. Magnets disposed about the chamber improve ionization. A neutralizing mechanism near the chamber outlet keeps the ion thruster electrically neutral.

20 Claims, 2 Drawing Sheets

AIR-BREATHING ELECTROSTATIC ION THRUSTER

CROSS-REFERENCE TO RELATED APPLICATIONS

None.

BACKGROUND OF THE INVENTION

A. Field of the Invention

The field of the present invention relates generally to propulsion systems that utilize charged particles to generate the propulsive forces to propel an object. More particularly, the present invention relates to ion thrusters that are adapted for use in the Earth's atmosphere. Even more particularly the present invention relates electrically powered, air-breathing ion thrusters capable of operating in low-Earth atmosphere.

B. Background

Propulsion systems that are capable of propelling a vehicle through the atmosphere that do not require a large quantity of fuel to be carried by the vehicle for its own consumption have long been desired. As is well known, a significant portion of the overall weight of a vehicle that travels through the atmosphere can be the fuel necessary to propel the vehicle. This generally results in a balance being chosen between the weight of non-fuel materials that can be carried by the vehicle or the distance the vehicle can travel, with a greater amount of materials reducing the quantity of fuel available, and therefore the distance the vehicle can travel, and the additional fuel for greater distance limiting the weight of materials that can be carried. To overcome this problem, propulsion systems with greater efficiency have been developed, particularly those that utilize readily available natural resources as the fuel, such as solar powered aircraft that utilize solar cell technology to power the vehicle's engine. Although other types of fuel systems have been developed or suggested for atmospheric vehicles, including various magnetically or nuclear powered propulsion systems, limitations due to efficiency and safety concerns have generally prevented full acceptance of such systems.

Propulsion systems utilizing ion engines for use in high atmosphere and space vehicles, including those which are configured for travel in the atmosphere of other planets, have been developed and somewhat successfully utilized for many years. The typical ion engine propulsion systems requires a propellant such as mercury, xenon, argon or cesium for ionization and operates as a Hall effect thruster. Electrons emitted by a cathode are directed into a discharge chamber where propellant is introduced to collide with the electrons in order to create positively charged ions that are rapidly expelled from the discharge chamber to generate the engine's thrust. An example of such a system is disclosed in U.S. Pat. No. 4,838,021 to Beattie, which describes an ion thruster having an ionization chamber formed by a cylindrical metallic conductive sidewall that functions as the anode in which propellant gas, such as xenon, is ionized by electrons emitted by a cathode to produce a plasma that expels an ion beam to create thrust. U.S. Pat. No. 3,952,228 to Reader, et al, describes a cylindrical shell which defines a chamber in which an ionizable propellant, such as argon, is introduced. Disposed symmetrically within the shell is a cylindrical anode, which has a cathode centrally positioned therein. An apertured screen and an aligned apertured grid at the open end of the cylinder draw ions along a beam path to create thrust. A major limitation to such propellant systems, as with conventional fuel powered vehicles, is the need to carry sufficient propellant to achieve the desired operation of the vehicle. Longer flight or other engine operation time requires the vehicle to carry larger quantities of propellant, which increases the weight of the vehicle and thrust requirements for the engine, which then requires a larger and generally heavier engine that needs even more propellant to effectively operate. As a result, there has been a need for vehicle propulsion systems utilizing ion powered engines that do not require the use of stored and carried propellant.

For operation in the Earth or other Earth-like atmospheres, there have been developed air-breathing ion engines that utilize ambient atmospheric gas, which is sufficiently ionizable, as the propellant. These engines draw in the atmospheric gas and ionize a portion of it utilizing cathode devices, instead of having to carry ionizable fuel on the vehicle, to achieve the desired thrust from the rapid discharge of charged ions. Some of these ion engines have been patented. For instance, U.S. Pat. No. 6,834,492 to Hruby, et al. describes an air-breathing electrically powered Hall effect thruster having a thruster duct with an inlet, an exit and a discharge zone therebetween, an electrically charged cathode for emitting electrons, an anode in the discharge zone that attracts the electrons and a magnetic circuit that establishes a radial magnetic field in the discharge zone. The magnetic field creates an impedance to the flow of electrons toward the anode to better ionize the atmospheric gas moving through the discharge zone. This enables ionization of the atmospheric gas and creates an axial electric field in the thruster duct for accelerating the ionized air through the exit to create thrust. U.S. Pat. No. 6,145,298 to Burton, Jr. describes an ion engine propulsion system that utilizes a high voltage power source to ionize a portion of high altitude ambient atmospheric gas to create a negative ionic plasma which bombards and accelerates the remaining atmospheric gas in a focused and directed path to an anode receiver to create thrust for propulsion. The cylindrical cathode is tapered, preferably to a fine point, and the anode is substantially ring-shaped or comprised of a plurality of concentric rings of decreasing diameter that are axially aligned with the tapered cathode. The tapered cathode and ring-shaped anode are disposed in a housing that has an inlet for receiving ambient atmospheric gas and an outlet for discharge. A voltage power source having a negative potential is connected to the cathode and a power positive source is connected to the anode. An electromechanical arrangement is provided to adjust the distance between the cathode and anode.

Despite the foregoing, there exists a need for an improved air-breathing electrostatic ion thruster for use in low-Earth atmosphere. The preferred ion thruster should utilize ambient atmospheric gases as the propellant so as to eliminate the need for the vehicle to store and carry a sufficient quantity of propellant. The preferred ion thruster should have a housing with an electrically conductive inner surface that defines a ionization chamber in which is disposed an electrically charged inner electrode and which has electrically charged screen electrodes at its inlet and outlet to repel, attract and accelerate ions so as to generate thrust due to the ionization of the atmospheric gas. The preferred ion thruster should be configured to be relatively simple to manufacture and operate and will provide long and reliable operation.

SUMMARY OF THE INVENTION

The air-breathing electrostatic ion thruster of the present invention discloses an improved electrostatic ion thruster that utilizes ambient atmospheric gas as the propellant, thereby eliminating the need for the vehicle having the ion thruster to store and carry propellant fuel. In the preferred embodiment, the ion thruster of the present invention has a housing formed with an non-conductive outer surface and a conductive inner surface that defines an ionization chamber into which the atmospheric gas is received and ionized by electrons emitted by an inner electrode (i.e., a cathode). In this preferred embodiment, an electrically charged screen electrode at the forward end of the chamber allows the atmospheric gas into the chamber where electrons from the inner electrode collide with the atmosphere gas to provide charged ions that are discharged rearward to create thrust. The preferred electrostatic ion thruster also has a screen electrode and an accelerator electrode at its rearward end to draw the charged ions rearward and accelerate them outward. In a preferred embodiment, one or more magnets act on the electrons to spiral them in a helix shape to increase their interaction with the atmospheric gas and improve the formation of ions. A neutralizing assembly at the rearward end of the housing maintains the ion thruster in a neutral electrical potential.

In one general embodiment of the present invention, the air-breathing electrostatic ion thruster comprises a housing having a forward end, a rearward end, an electrically conductive inner surface that defines an ionization chamber and an electrically non-conductive outer surface. The ionization chamber has an inlet at the forward end of the housing to receive ambient atmospheric gas and an outlet at the rearward end of the housing to discharge charged ions so as to create thrust to propel a vehicle utilizing the ion thruster of the present invention. Positioned at the inlet of the chamber is an electrically charged forward screen electrode that has a plurality of forward screen apertures which are configured to allow the atmospheric gas to flow into the ionization chamber. An inner electrode is disposed in the ionization chamber near the inlet and generally rearward of the forward screen electrode. In the preferred embodiment, the inner electrode is a cathode configured to emit electrons to ionize the atmospheric gas in the ionization chamber and generate a plurality of positively charged ions. At or near the outlet of the chamber is positioned an electrically charged rearward screen electrode that has a plurality of rearward screen apertures. Positioned generally rearward of the rearward screen electrode is an electrically charged accelerator electrode of a grid configuration having a plurality of accelerator apertures. The rearward screen apertures are substantially aligned with the accelerator apertures so as to allow the charged ions to pass through the outlet to generate thrust. A source of electrical power, which can be solar cells, a battery or a generator, is electrically connected to the inner surface, the forward screen electrode and the rearward screen electrode so as to provide current of a first polarity, which in the preferred embodiment is positive. The source of electrical power is also electrically connected to the inner electrode and the accelerator electrode to provide a current of a second polarity, which in the preferred embodiment is negative. A controller operatively connects to the source of electrical power to vary the current and/or the polarity supplied by the source of electrical power. The controller includes an microprocessor and is suitable for controlling locally or from a remote location (i.e., a land station). One or more magnets are disposed about the ionization chamber to provide a magnetic field that increases the mixing of the electrons and the atmospheric gas so as to improve ionization in the ionization chamber. A neutralizing mechanism, which can comprise a neutralizer electrode (i.e., in the preferred embodiment it is a cathode), is positioned at or near the outlet to maintain the ion thruster in an electrically neutral condition.

In operation, the source of electrical power supplies electrical current having a first polarity to the inner surface, forward screen electrode and rearward screen electrode and supplies electrical current having a second polarity to the accelerator electrode and inner electrode. In the preferred embodiment, the first polarity is positive and the second polarity is negative, with the inner electrode being a cathode. The ambient atmospheric gas enters the ionization chamber through the forward screen electrode at the inlet to mix with the electrons emitted by the cathode to generate positively charged ions (in the preferred embodiment). Because the polarity of forward screen electrode is also positive, the forward screen electrode repels the positively charged ions away from the inlet in a generally rearward direction. The positively charged screen electrodes and inner surface will attract the electrons from the cathode to facilitate mixture thereof with the atmospheric gas to generate the positive ions. The negatively charged accelerator electrode attracts the positively charged ions and accelerates them through the chamber outlet at the rearward end of the housing to provide accelerated ions for generating thrust.

Accordingly, the primary objective of the present invention is to provide an air-breathing electrostatic ion thruster that provides the advantages discussed above and overcomes the disadvantages and limitations associated with presently available ion thrusters.

It is also an important object of the present invention to provide an air-breathing electrostatic ion thruster that utilizes ambient atmospheric gases as the propellant to eliminate the need to store and carry propellant in a vehicle powered by the present ion thruster.

It is also an important object of the present invention to provide an air-breathing electrostatic ion thruster that operates efficiently and effectively in the low-Earth atmosphere for extended periods of time.

It is also an important object of the present invention to provide an air-breathing electrostatic ion thruster that utilizes a screen electrode at the forward end of an ionization chamber, defined by an electrically conductive inner surface, that allows atmospheric gas into the chamber where electrons emitted by a cathode disposed in the chamber ionizes the atmospheric gas and a screen electrode and a spaced apart but aperture aligned accelerator electrode at the rearward end of the chamber draws and accelerates the ions out the rear of the thruster to create thrust.

It is also an important object of the present invention to provide an air-breathing electrostatic ion thruster that utilizes one or more magnetic assemblies to cause the electrons within the chamber to spiral in a manner so as to improve the interaction with the atmospheric gas and increase the formation of ions.

It is also an important object of the present invention to provide an air-breathing electrostatic ion thruster that is relatively simple to manufacture and operate and which preferably does not require moving parts so as to improve the usefulness and reliability thereof.

The above and other objectives of the present invention will be explained in greater detail by reference to the attached figures and the description of the preferred embodiment which follows. As set forth herein, the present invention resides in the novel features of form, construction, mode of operation and combination of processes presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. As will be readily understood by those skilled in the art, the enclosed figures and drawings are merely illustrative of a preferred embodiment and represents one of several different ways of configuring the present invention. Although specific components, materials, configurations and uses are illustrated, a number of variations to the components and to the configuration of those components described herein and in the accompanying figures can be made without changing the scope and function of the invention set forth herein. For instance, although the figures and description provided herein are directed to a generally cylindrical housing having certain materials and arrangement of components, those skilled in the art will readily understand that this is merely for purposes of simplifying the present disclosure and that the present invention is not so limited.

Figure 1:
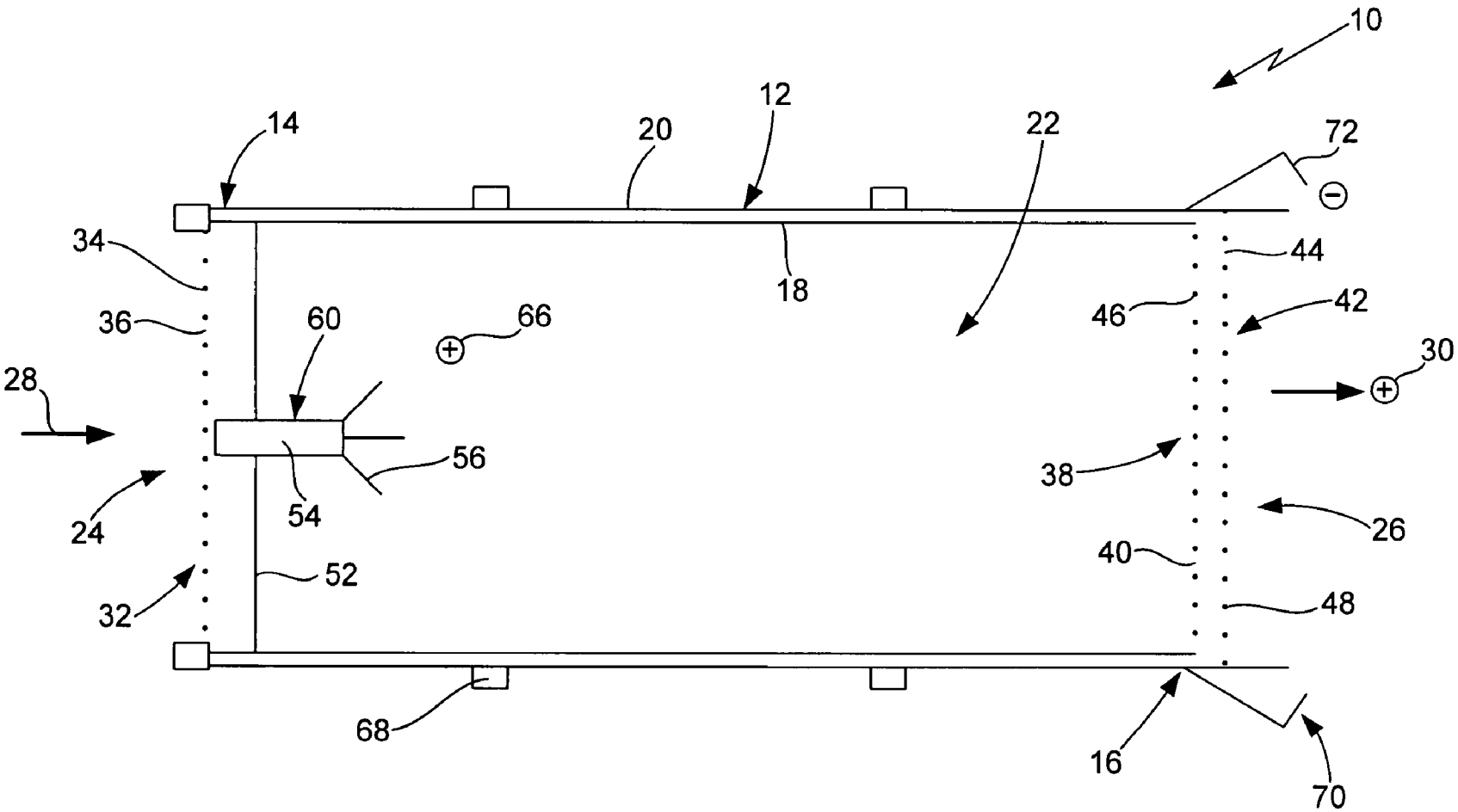
FIG. 1 is cross-sectional side view of an air-breathing electrostatic ion thruster configured according to a preferred embodiment of the present invention showing atmospheric gas being drawn into the ionization chamber and accelerated ions being discharged therefrom to create thrust.

An air-breathing electrostatic ion thruster that is manufactured out of the components and configured pursuant to a preferred embodiment of the present invention is shown generally as 10 in the figures. Ion thruster 10 generally comprises a housing 12 having a first or forward end 14, a second or rearward end 16, an electrically conductive inner surface 18 and an electrically non-conductive outer surface 20, as shown in FIG. 1. In a preferred embodiment, housing 12 will be made out of a generally lightweight material that has its interior coated with a conductive material to form inner surface 18 and its exterior coated with a non-conductive/insulating material to form outer surface 20. In an alternative embodiment, both inner 18 and outer 20 surfaces are formed from separate cylindrically shaped shells that are joined in abutting relation, with the inner shell, defining inner surface 18, disposed symmetrically within the outer shell, defining outer surface 20, to substantially provide an integral housing 12 having an inner conductive layer and an outer non-conductive layer. Preferably, inner surface 18 will be formed from a metallic material that is known to be highly conductive, such as brass, aluminum, magnesium, copper or like materials. Conversely, outer surface 20 should be formed from an electrically non-conductive, insulating material such as plastic or nylon, with materials such as Delrin, a trademark of DuPont, or the like being preferred due to its resistance to high voltage and high temperature breakdown. Inner surface 18 defines an ionization chamber 22 having an inlet 24 at the forward end 14 of housing 12 and an outlet 26 at the rearward end 16. As explained in more detail below, ambient atmospheric gas 28 is received through inlet 24 and is ionized in ionization chamber 22, with inner surface 18 functioning as an anode (a cylindrical anode in FIG. 1), to discharge accelerated ions 30 through outlet 26 at the rearward end 16 of housing 12 so as to create thrust to propel a vehicle (not shown) utilizing ion thruster 10 of the present invention.

Positioned inside inlet 24, generally at or near forward end 14 of housing 12 and attached thereto, is forward screen electrode 32. In one embodiment, forward screen electrode 32 has a plurality of spaced apart electrically conductive metallic wires or members 34 that define a plurality of forward screen apertures 36 of sufficient size to easily permit atmosphere gas 28 to pass therethrough into ionization chamber 22. Alternatively, forward screen electrode 32 can be other screen or screen-like devices, such as a plate having the plurality of forward screen apertures 36. As explained below, however, the wires or other electrically conductive members 34 forming forward screen electrode 32 must have sufficient surface area to apply an electrical charge thereto. As will be clearly understood by those skilled in the art, a variety of different configurations are possible for forward screen electrode 32, including a typical screen configuration having square, rectangular, circular or oval apertures 36 or formed from metallic or other electrically conductive wires or members 34 that are joined together in a manner that provides sufficient gaps for apertures 36 (i.e., slits or slots similar to blinds, etc.). Positioned inside outlet 26 generally at or near rearward end 16 of housing 12, and attached thereto, is rearward screen electrode 38 having rearward screen apertures 40 and accelerator electrode (or grid) 42 having accelerator apertures 44. As shown in FIG. 1, accelerator electrode 42 is positioned rearward of and in spaced apart relation to, although generally close to, rearward screen electrode 38 in a manner such that the rearward screen apertures 40 are aligned with accelerator apertures 44. As with forward screen electrode 32, the apertures 40 and 44 of both rearward screen electrode 38 and accelerator electrode 42 can be defined by a plurality of metallic wire or other electrically conductive members, shown as 46 and 48, that provide sufficient surface area to apply an electrical charge thereto (alternatively it can be other screen or screen-like devices, such as a plate having the plurality of rearward screen apertures 40). The apertures 40 and 44 of rearward screen electrode 38 and accelerator electrode 42, respectively, should be sufficiently sized and configured to permit the flow of charged, accelerated ions 30 to generally pass therethrough. The function of forward screen electrode 32, rearward screen electrode 38 and accelerator electrode 42 in ion thruster 10 of the present invention is explained below.

Disposed inside ionization chamber 22, preferably near forward screen electrode 32 at inlet 24, is inner electrode 50. As shown in the preferred embodiment of FIG. 1, inner electrode 50 is generally positioned at or near the center of ionization chamber 22 and held in place by insulating struts 52, which preferably connect to inner surface 18 or housing 12. Alternatively, struts 52 can connect to forward screen electrode 38 or rearward screen electrode 38. Various different configurations for inner electrode 50 can be utilized with ion thruster 10 of the present invention. In the preferred embodiment of FIG. 1, inner electrode 50 comprises a support tube 54 connected to struts 52 with a plurality of conductive electrode emitters 56 extending rearward therefrom. In the preferred embodiment, inner electrode 50 is a cathode configured to emit electrons into ionization chamber 22 to ionize the atmospheric gas 28 entering through inlet 24. As explained in more detail below, once the atmospheric gas 28 is ionized it will be drawn toward rearward and accelerated by accelerator screen 42 to displace accelerated ions 30 rearward of ionization chamber 22 to create thrust so as to propel a vehicle utilizing ion thruster 10 of the present invention.

Figure 2:
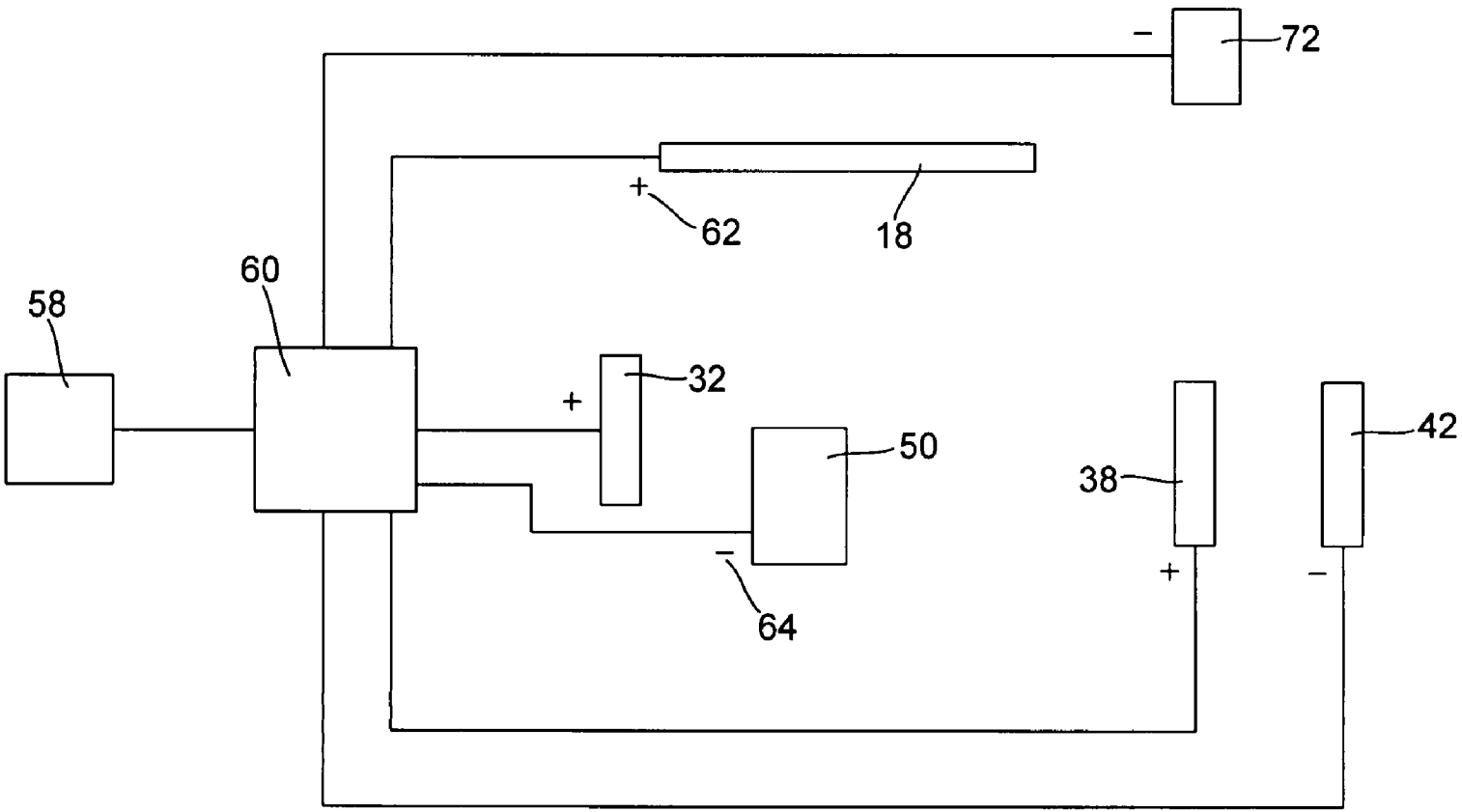
FIG. 2 is a schematic view of the electrical circuit for an air-breathing electrostatic ion thruster configured according to a preferred embodiment of the present invention.

As shown in the schematic of FIG. 2 for the electrical circuit for ion thruster 10 of the present invention, a source of electrical power 58 supplies current to the conductive inner shell (anode) 18, inner electrode 50 and the various electrodes 32, 38 and 42 utilized for ion thruster 10, as well as other components described below. In a preferred embodiment, the source of electrical power 58 is a solar cell array connected to a battery or fuel cell. Alternatively, various other sources of electrical power 58, such as a small generator or the like, which is suitable for the vehicle utilized with ion thruster 10 may be provided as the source of electrical power 58. Preferably, a controller 60 is utilized with ion thruster 10 of the present invention to control the voltages supplied to the various components and the polarity thereof. In a preferred configuration, controller 60 controls the source of electrical power 58 to deliver a first polarity 62, which is positive, to inner surface 18, forward screen electrode 32 and rearward screen electrode 38 and deliver a second polarity 64, which is negative, to accelerator electrode 42 and inner electrode (cathode) 50, as shown in FIG. 2. Alternatively, the polarity supplied by the source of electrical power 58 can be switched so as to be reversed. As well known to those skilled in the art, the electronic signals from controller 60 are preferably controlled by a microprocessor that initiates and regulates the amount of thrust generated by ion thruster 10. As also well known, the controller 60 can be positioned on ion thruster 10, in the vehicle using ion thruster 10 or at a ground station or other remote station. Depending on the desired effects, the various voltages and/or the polarity thereof can be controlled by controller 60 to create the optimal thrust based on the circumstances. In an alternative configuration, ion thruster 10 comprises a plurality of separate sources of electrical power 58 and/or a plurality of separate controllers 60 that individually, but in cooperative fashion, operate the components of ion thruster 10.

In operation, the source of electrical power 58 (as controlled by controller 60) supplies electrical current having a first polarity 62 to inner shell 18, forward screen electrode 32 and rearward screen electrode 38 and supply electrical current having a second polarity 64 to accelerator electrode 42 and inner electrode 50. Ambient atmospheric gas 28 enters ionization chamber 22 through forward screen electrode 32 at inlet 24 to mix with the electrons emitted by the cathode (inner electrode 50) at electrode emitters 56 to generate positively charged ions (in the preferred embodiment with first polarity 62 being positive and second polarity 64 being negative), shown as 66 in FIG. 1. Because the polarity of forward screen electrode 32 is also positive, the forward screen electrode 32 will repel the positively charged ions 66 away from inlet 24 in a generally rearward direction. The positively charged rearward screen electrode 38 and inner surface 18 (having first polarity 62) will attract the electrons from inner electrode/cathode 50 to facilitate mixture thereof with the atmospheric gas 28 to generate positive ions 66. The negatively charged (second polarity 64) accelerator electrode 42 will attract the positively charged ions 66 and accelerate them through the outlet 26 at the rearward end 16 of housing 12 to provide accelerated ions 30 for thrust. The positively charged (first polarity 62) conductive inner surface 18 will maintain the positively charged ions 66 moving rearward in ionization chamber 22. With the preferred solar cell array and battery/fuel cell arrangement for the source of electrical power 58, ion thruster 10 will be able to operate for an extended period of time without additional input of energy.

In the preferred embodiment of ion thruster 10 of the present invention, one or more magnets or series of magnets 68 are positioned outside housing 12, as shown in FIG. 1, or inside ionization chamber 22 to surround portions of the ionization chamber 22. As known to those skilled in the art, magnets 68 can be permanent or electromagnetic, with the latter being preferred, and magnets 68 can be positioned inside chamber 22. If electromagnetic magnets 68 are utilized, they can be electrically connected to the source of electrical power 58 and the amount of current supplied thereto can be regulated by controller 60. The magnetic field produced by magnets 68 will cause the electrons to spiral in a helix shape to obtain improved interaction (i.e., collision) between the electrons and the atmospheric gas 28 to facilitate more efficient and effective formation of the positive ions 66 necessary to provide thrust for ion thruster 10. In addition, the axial magnetic field within ionization chamber 22 created by magnets 68 will tend to restrain the path of the electrons emitted by cathode 50 to inhibit them from being drawn directly to inner surface 18 (the anode), thereby preventing excessive loss of electrons that are needed to form positively charged ions 66 from atmospheric gas 28.

Also in the preferred embodiment, shown in FIG. 1, ion thruster 10 includes a neutralizing mechanism or means 70 near the rearward end 16 of housing 12 (near outlet 26) to interact with the accelerated ions 30 exiting ionization chamber 22 at outlet 26 so as to place the ion thruster 10 in an electrically neutral condition. In the preferred polarity arrangement, with first polarity 62 being positive and second polarity 64 being negative, neutralizing mechanism 70 comprises a negatively charged neutralizer electrode 72 that emits electrons to compensate for the flow of positively charged accelerated ions 30. As shown on FIG. 2, in the preferred embodiment the neutralizer electrodes 72 are electrically connected to the source of electrical power 58 and, also preferably, controlled or regulated by controller 60.

The preferred embodiment of ion thruster 10 of the present invention will incorporate an ozone reduction mechanism (not shown) at or near the rearward end 16 of housing 12 to interact with the discharge gas produced by the ion thruster 10 so as to reduce or even eliminate the ozone that is a by-product of the ionization process. Various other variations are also possible for ion thruster 10. For instance, the size and configuration of housing 12 and the ionization chamber 22 can be varied, as well as the operating voltages, polarity, positioning and size/shape of the electrodes, size and shape of the inlet and/or outlet (i.e., so as to compress the atmospheric air 28 or otherwise tuned for aerodynamic purposes) and the materials used for the various components of ion thruster 10 so as to obtain the most efficient amount of thrust generation for the desired purposes of the vehicle. In addition, the size, placement (including whether inside or outside ionization chamber 22), type (i.e., permanent or electromagnetic magnets), shape and magnetic strength of magnets 68 can be varied.

While there are shown and described herein a specific form of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape, and use. For instance, there are numerous components described herein that can be replaced with equivalent functioning components to accomplish the objectives of the present invention.

What is claimed is:

1. An air-breathing electrostatic ion thruster, comprising:

a housing having a forward end, a rearward end and an electrically conductive inner surface, said inner surface defining an ionization chamber in said housing, said ionization chamber having an inlet at said forward end to receive a gas and an outlet at said rearward end to discharge charged ions;

a forward screen electrode at said inlet, said forward screen electrode configured to allow said gas to flow therethrough into said ionization chamber;

an inner electrode disposed in said ionization chamber, said inner electrode configured to ionize said gas in said ionization chamber so as to generate a plurality of charged ions;

a rearward screen electrode at said outlet;

an accelerator electrode at said outlet generally rearward of said rearward screen electrode, said rearward screen electrode and said accelerator electrode substantially aligned to allow said charged ions to pass through said outlet to generate thrust; and a source of electrical power electrically connected to said inner surface, said forward screen electrode and said rearward screen electrode so as to provide current of a first polarity and electrically connected to said inner electrode and said accelerator electrode so as to provide current of a second polarity.

2. The ion thruster according to claim 1, wherein said gas is an ambient atmospheric gas.

3. The ion thruster according to claim 1, wherein said inner surface is integral with, coated on or abutting said housing.

4. The ion thruster according to claim 1, wherein said housing further comprises an electrically non-conductive outer surface, said outer surface integral with, coated on or abutting said housing.

5. The ion thruster according to claim 1, wherein said forward screen electrode has a plurality of forward screen apertures sized and configured to allow said gas to pass therethrough.

6. The ion thruster according to claim 1, wherein said rearward screen electrode has a plurality of rearward screen apertures and said accelerator electrode has a plurality of accelerator apertures, said accelerator apertures substantially aligned with said rearward screen apertures.

7. The ion thruster according to claim 1, wherein said first polarity is positive and said second polarity is negative, said inner electrode configured to emit electrons and said plurality of charged ions being positive.

8. The ion thruster according to claim 1 further comprising a controller operatively connected to said source of electrical power, said controller configured to vary the current and/or the polarity supplied by said source of electrical power.

9. The ion thruster according to claim 1 further comprising one or more magnets about said ionization chamber, said magnets configured to improve ionization of said gas in said ionization chamber.

10. The ion thruster according to claim 9, wherein said magnets are disposed outside of said housing.

11. The ion thruster according to claim 9, wherein said magnets are electromagnetic.

12. The ion thruster according to claim 1 further comprising means at or near said rearward end of said housing for substantially neutralizing said plurality of charged ions discharged from said outlet.

13. The ion thruster according to claim 12, wherein said neutralizing means comprises a neutralizer electrode.

14. An air-breathing electrostatic ion thruster, comprising:

a housing having a forward end, a rearward end and an electrically conductive inner surface, said inner surface defining an ionization chamber in said housing, said ionization chamber having an inlet at said forward end to receive an ambient atmospheric gas and an outlet at said rearward end to discharge charged ions;

an electrically charged forward screen electrode at said inlet, said forward screen electrode having a plurality of forward screen apertures configured to allow said atmospheric gas to flow therethrough into said ionization chamber;

an inner electrode disposed in said ionization chamber generally rearward of said forward screen electrode, said inner electrode configured to ionize said gas in said ionization chamber so as to generate a plurality of charged ions;

an electrically charged rearward screen electrode at said outlet, said rearward screen electrode having a plurality of rearward screen apertures;

an electrically charged accelerator electrode at said outlet generally rearward of said rearward screen electrode, said accelerator electrode having a plurality of accelerator apertures, said rearward screen apertures in substantial alignment with said accelerator apertures to allow said charged ions to pass through said outlet to generate thrust; and a source of electrical power electrically connected to said inner surface, said forward screen electrode and said rearward screen electrode so as to provide current of a first polarity and electrically connected to said inner electrode and said accelerator electrode so as to provide a current of a second polarity.

15. The ion thruster according to claim 14, wherein said first polarity is positive and said second polarity is negative, said inner electrode configured to emit electrons and said plurality of charged ions being positive.

16. The ion thruster according to claim 14 further comprising a controller operatively connected to said source of electrical power, said controller configured to vary the current and/or the polarity supplied by said source of electrical power.

17. The ion thruster according to claim 14 further comprising one or more magnets about said ionization chamber, said magnets configured to improve ionization of said atmospheric gas in said ionization chamber.

18. The ion thruster according to claim 14 further comprising means near or at said rearward end of said housing for substantially neutralizing said plurality of charged ions discharged from said outlet.

19. An air-breathing electrostatic ion thruster, comprising:

a housing having a forward end, a rearward end, an electrically conductive inner surface and an electrically non-conductive outer surface, said inner surface defining an ionization chamber in said housing, said ionization chamber having an inlet at said forward end to receive an ambient atmospheric gas and an outlet at said rearward end to discharge charged ions;

an electrically charged forward screen electrode at said inlet, said forward screen electrode having a plurality of forward screen apertures configured to allow said atmospheric gas to flow therethrough into said ionization chamber;

an inner electrode disposed in said ionization chamber generally rearward of said forward screen electrode, said inner electrode configured to ionize said gas in said ionization chamber so as to generate a plurality of charged ions;

an electrically charged rearward screen electrode at said outlet, said rearward screen electrode having a plurality of rearward screen apertures;

an electrically charged accelerator electrode at said outlet generally rearward of said rearward screen electrode, said accelerator electrode having a plurality of accelerator apertures, said rearward screen apertures in substantial alignment with said accelerator apertures to allow said charged ions to pass through said outlet to generate thrust;

a source of electrical power electrically connected to said inner surface, said forward screen electrode and said rearward screen electrode so as to provide current of a first polarity and electrically connected to said inner electrode and said accelerator electrode so as to provide a current of a second polarity;

a controller operatively connected to said source of electrical power, said controller configured to vary the current and/or the polarity supplied by said source of electrical power; and one or more magnets disposed about said ionization chamber, said magnets configured to improve ionization of said atmospheric gas in said ionization chamber.

20. The ion thruster according to claim 19 further comprising means near or at said rearward end of said housing for substantially neutralizing said plurality of charged ions discharged from said outlet.

* * * * *